United States Patent [19]

Fritsch

[11] Patent Number: 4,811,624

[45] Date of Patent: Mar. 14, 1989

[54] HYDRAULICALLY ACTUATED STROKE ADJUSTING DEVICE

[75] Inventor: Horst Fritsch, Leonberg, Fed. Rep. of Germany

[73] Assignee: Lewa Herbert OTT GmbH & Co., Fed. Rep. of Germany

[21] Appl. No.: 828,043

[22] Filed: Feb. 10, 1986

[30] Foreign Application Priority Data

Feb. 14, 1985 [DE] Fed. Rep. of Germany ..... 3505133

[51] Int. Cl.[4] ..... G05G 1/00

[52] U.S. Cl. ..... 74/571 L; 92/13.1; 92/13.3; 92/13.7

[58] Field of Search ..... 74/571 L, 835, 836; 92/13.1, 13.3, 13.7

[56] References Cited

U.S. PATENT DOCUMENTS

| | | | |
|---|---|---|---|
| 3,398,691 | 8/1968 | Sato et al. | 92/13.7 |
| 3,906,842 | 9/1975 | Sonobe | 92/13.7 |
| 3,927,528 | 12/1975 | Kolk et al. | 74/861 |
| 3,974,714 | 8/1976 | Fritsch | 74/571 L |

*Primary Examiner*—Kenneth J. Dorner
*Assistant Examiner*—Gerald A. Anderson
*Attorney, Agent, or Firm*—Bierman and Muserlian

[57] ABSTRACT

In a stroke adjusting device on pumps, in particular proportioning pumps, a hydraulic actuation occurs due to the fact that a hollow shaft, which guides in its interior a sliding shaft, is formed as a hydraulic cylinder, in which the sliding shaft, designed as a double action hydraulic piston, is slidable axially in both directions by means of a hydraulic fluid. Owing to this, the required axial adjusting movement of the sliding shaft is not brought out of the hollow shaft axially to the outside, whereby the two ends of the hollow shaft are kept free for the coupling of several engines or pumps.

11 Claims, 5 Drawing Sheets

HYDRAULICALLY ACTUATED STROKE ADJUSTING DEVICE

Figure 1:
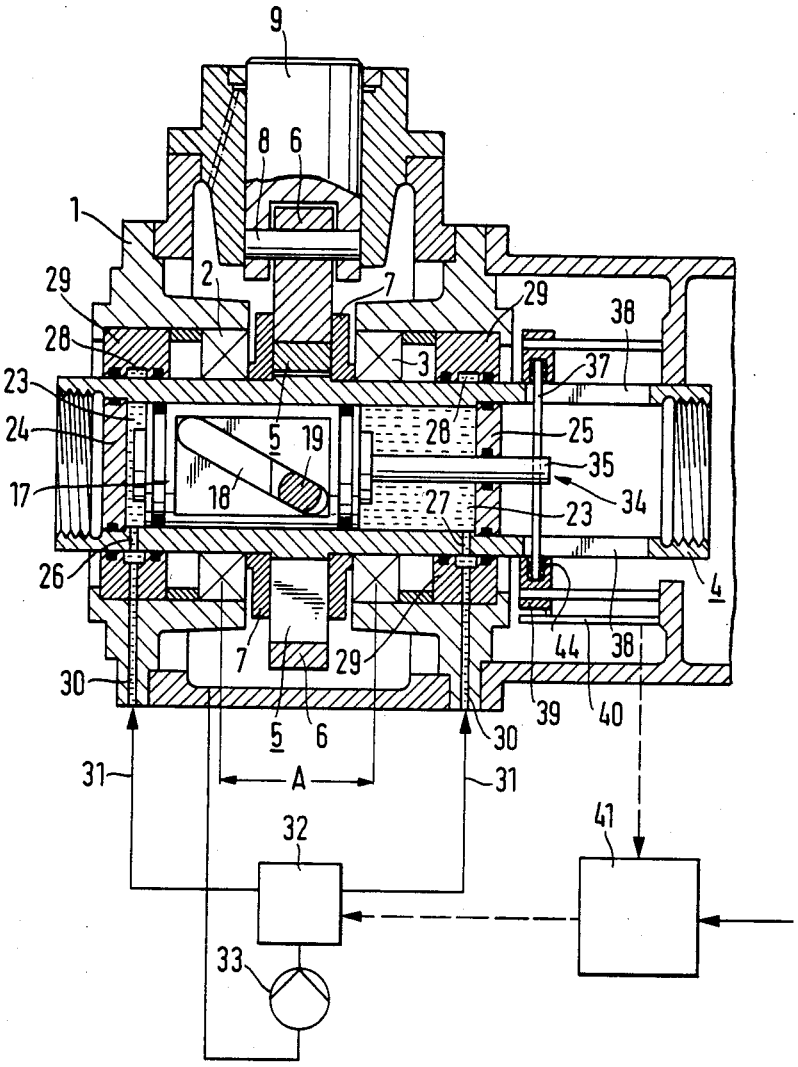

The invention relates to a stroke adjusting device, in particular on pumps, according to the preamble of claim 1.

In a known stroke adjusting device of this kind (DE-PS 24 46 806 of the Applicant), there serves as positioning element a slit extending obliquely to the shaft axis in the sliding shaft, into which slit a coupling bolt engages. The latter in turn traverses the hollow shaft in the region of segments provided on both sides, and also traverses the eccentric disk, which, by a radial cutout provided in it, is radially displaceable on the hollow shaft in the region of the latter's segment-like cutout faces.

In this known stroke adjusting device, the actuation for the purpose of adjusting the pump stroke occurs by mechanical displacement of the sliding shaft in axial direction. The introduction of force in sliding direction occurs from the outside, either through a setting spindle actuated manually by means of a handwheel or by electric rotary drive, or via a thrust rod which is moved by a pneumatic setting drive or by electric thrust drive.

Such a stroke adjusting device has definite advantages over earlier known devices. They reside in particular in that the drive forces are not passed over the actual adjusting elements, so that they do not weigh on the adjusting movement.

If, however, several engines or pumps, provided with such a stroke adjusting device, are to be connected as one unit and accordingly are to be coupled together side by side, this can take place only at the fast drive shaft, whose speed has not yet been reduced by a worm gear or the like to the desired engine speed. Such coupling of several engines in parallel at the fast drive shaft is necessary for the reason that no space is available for coupling at the two ends of the hollow shaft of the stroke adjusting device, because, as has been stated before, the structural elements that bring about the axial displacement movement of the sliding shaft, such as setting spindles and the like, are brought out of one end of the hollow shaft axially.

But such an arrangement in the coupling of several engines or pumps side by side at the fast drive shaft has the result that not only a greater space requirement exists, but also that for each engine unit a separate stepdown transmission and a separate stroke adjusting device are required. This increases the cost of manufacture of multiple pumps.

Lastly it has been found also that manual operation of a stroke adjusting device by a setting spindle or handwheel requires much force on relatively large engines, which, of course, should be avoided.

It is, therefore, the object of the invention to design the stroke adjusting device of the kind in question with a smaller number of parts required for the adjusting, in such a way that the axial movement of the sliding shaft is not brought axially out of the hollow shaft, in order thereby to keep the two ends of the hollow shaft free for the coupling of several engines or pumps, and that further the required force for stroke adjustment in large engines is reduced.

This problem is solved by the features of claim 1. Advantageous developments thereof are indicated in the additional claims.

In the stroke adjusting device according to the invention, the hollow shaft is designed as a hydraulic cylinder in which the sliding shaft, designed as a double-action hydraulic piston is axially displaceable in both directions by means of a hydraulic fluid.

Thus, in a surprisingly simple manner, space is created at both ends of the hollow shaft for the coupling of any number of additional engines, in order thereby to produce inexpensive multiple pumps.

The design as provided by the invention can be realized in an extremely simple manner, as it suffices to provide a rotating, double-action hydraulic cylinder, which constitutes a structural element known in itself, to achieve the basic hydraulic actuation of the stroke adjusting device of the invention and thereby to obtain a substantial saving of space at both ends of the hollow shaft.

All in all, there is thus created a continuous hollow shaft, so that several eingle engines or pumps can be coupled one behind the other at the hollow shaft, i.e. at the so-called slow shaft. This permits in the desired manner the creation of inexpensive multiple pumps, eliminating at the same time the integrated stepdown transmission hitherto required for each single engine.

Another advantage results in multiple pumps whose stroke lengths are to be adjusted synchronously. It is then sufficient to design only one hollow shaft, in particular the first hollow shaft, as hydraulic cylinder and the associated sliding shaft as hydraulic piston. In this case one obtains the synchronous stroke adjustment in a simple manner by connecting the respective sliding shaft with the additional sliding shafts by thrust rods.

Furthermore it is no longer necessary to arrange the driving wheel for the hollow shaft between the two hollow shaft bearings; the driving wheel can be provided at any desired other point of the hollow shaft, so that a smaller bearing distance at the hollow shaft is attainable. Thus also the dimensions of all pertinent structural parts can be reduced.

The fact that the bearings of the hollow shaft can be arranged closer together necessarily results in shorter distances between supports and hence also in a considerably reduced bending moment.

All in all, not only does the stroke adjusting device designed according to the invention result in a shorter overall length, but also a simple inexpensive stroke adjustment in multiple pumps is possible. In addition, the invention permits a simple automatic stroke adjustment and an extremely easy manual setting of the stroke length, as it is no longer necessary to provide a large handwheel for adjusting the sliding shaft.

For this purpose the sliding shaft is equipped with a mechanical or electrical position signaler, which records the respective position of the sliding shaft as actual value and signals it to the control unit, in which the desired value of the sliding shaft position is settable.

The control unit controls the fluid stream of the hydraulic pump via a control valve in such a way that the actual value, which is supplied via the position signaler, is identical with the desired value put in.

In a preferred form of the invention, the actual value of the stroke length is not measured by means of a position signaler connected with the sliding shaft, but is picked up directly at the piston rod, for example by a displacement sensor, and signaled to the control unit.

Lastly, there are no corrosion problems of any kind at the actual stroke adjusting device, and explosion protection as required in some cases can easily be provided for the device.

It is further of special advantage if the hydraulic fluid used for the actuation of the hydraulic piston is a lubricating oil which serves at the same time for pressure lubrication of the actual pump engine. Owing to this no separate oil pump is necessary, thereby further reducing the manufacturing costs.

Figure 2:
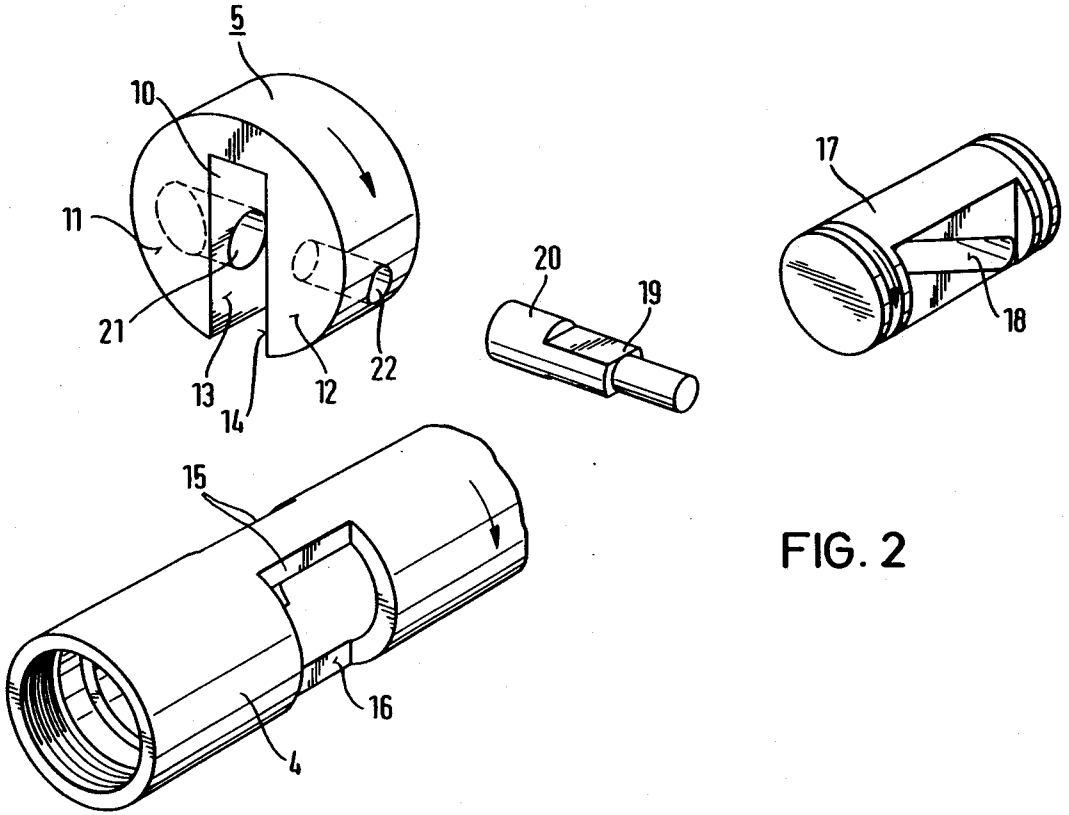

In the following, the invention will be explained more specifically with reference to the drawings, in which:

FIG. 1 shows the stroke adjusting device according to the invention, intended for for a pump, in section, and FIG. 2, an exploded view of some essential parts thereof, in perspective.

Figure 3:
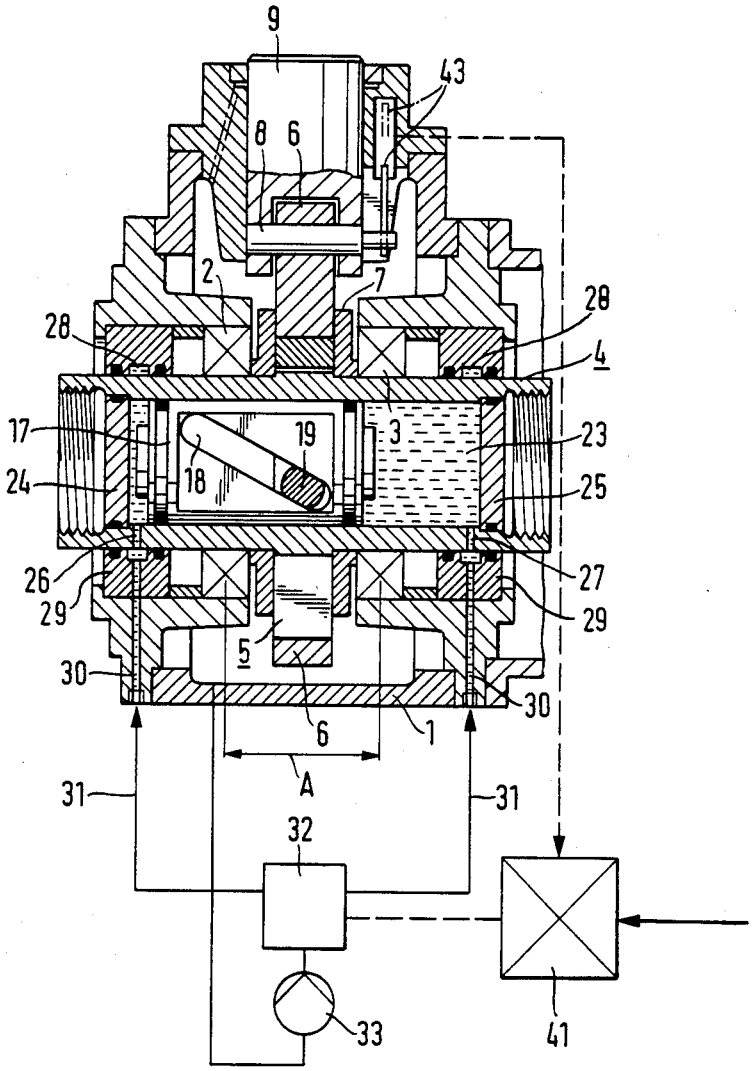
Figure 4:
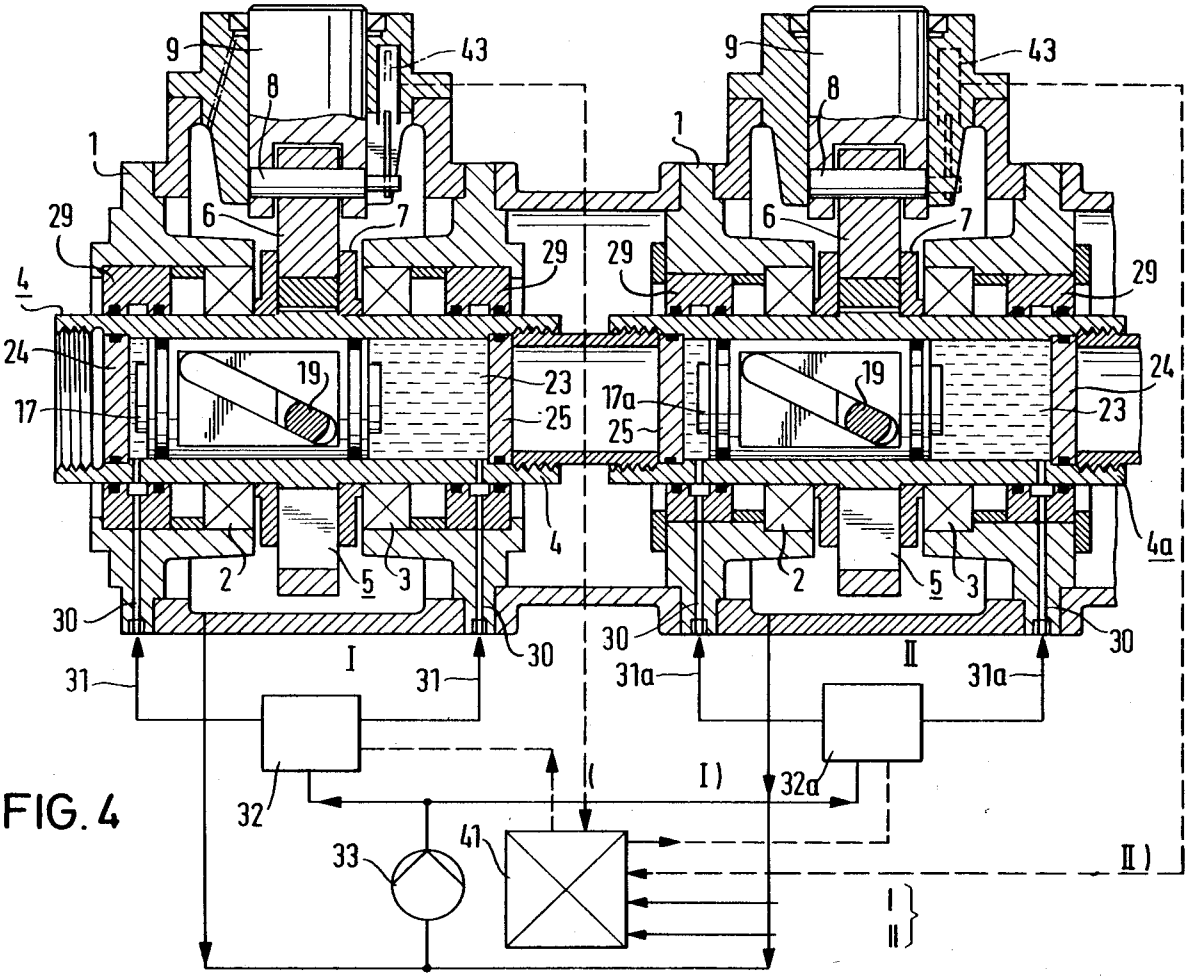
Figure 5:
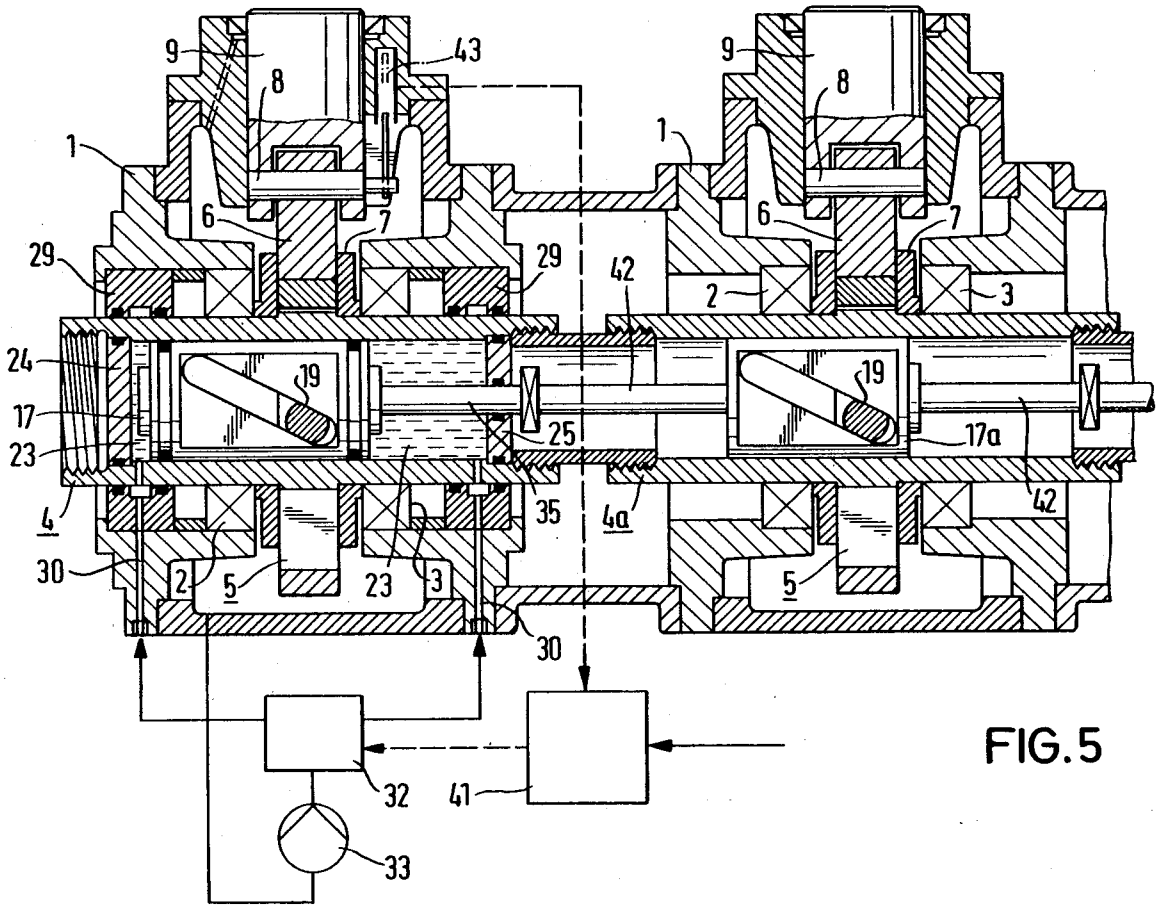

FIG. 3, in section, a modified stroke adjusting device;

FIG. 4, two engines coupled side by side, with different stroke length setting, and FIG. 5, with synchronous stroke setting.

As can be seen from the drawing, in particular from FIG. 1, in an engine housing 1 there is rotatably mounted by means of bearings 2 and 3 a hollow shaft 4, which is driven by a drive wheel not shown in detail at any desired distant end. Hollow shaft 4 transmits its rotary motion to an eccentric disk non-rotationally connected therewith, which disk is designed as rotary part according to FIG. 2 and serves as pivot bearing for a connecting rod 6. The eccentric disk 5 is held on hollow shaft 4 by two support disks 7.

By the eccentric disk 5 the connecting rod 6 is set in oscillating motion, this motion being derived in the usual manner from a cardan joint head 8 of connecting rod 6, and being then transmitted to the piston rod 9 of a hydraulic piston (not shown in detail) of the pump to be driven.

For non-rotational connection with the hollow shaft 4, the eccentric disk 5 comprises, as can clearly be seen from FIG. 2, a radial cutout 10, by which are formed two opposite legs 11 and 12 with mutually parallel faces 13 and 14. The latter are slipped on similarly formed parallel, diametrically opposite cutout faces 15, 16 of hollow shaft 4. These are formed by cutting out of the hollow shaft 4 corresponding segments in the manner evident from FIG. 2. Thus the eccentric disk 5 can be displaced radially relative to hollow shaft 4 and it is also non-rotationally connected with the hollow shaft 4 directly, so that the drive forces passed from the hollow shaft 4 directly to the eccentric disk 5 need not be transmitted also by other parts of the actual stroke adjusting device.

Inside the hollow shaft 4 a sliding shaft 17 is guided, which is displaceable in the direction of the longitudinal axis of hollow shaft 4 and, as can be seen from FIG. 2, has parallel faces forward in adaptation to the cutout faces 15, 16 of hollow shaft 4. In the region of these parallel faces of sliding shaft 17, a slit 18 serving as positioning member with ends closed at both sides is provided, which obliquely and symmetrically traverses the axis of the sliding shaft 17 in such a way that the two ends of slit 18 are opposite each other with respect to the shaft axis.

By its parallel wall faces, slit 18 positively guides a sliding block 19, which has correspondingly formed plane parallel side faces and is non-rotationally connected with the eccentric disk 5. For this purpose the sliding block 19 is inserted with exact fit into the radial cutout 10 of eccentric disk 5 and is mounted there by means of a coupling bolt 20 connected with it or in one piece with it. By its two ends this coupling bolt 20 traverses a bore 21, 22 in the two legs 11, 12 of eccentric disk 5 and passes through the hollow shaft 4 in the region of its segments. As can be seen from FIG. 2, the left end of coupling bolt 20 and the sliding block 19 have the same diameter, while the right end of coupling bolt 20 has a smaller diameter, to which the diameter of the associated bore 22 of the eccentric disk 5 is adapted. Thus the coupling bolt 20 with sliding block 19 can be mounted easily and quickly by insertion from the left into bore 21 of eccentric disk 5.

All in all, the arrangement is such that the barycenters of the plane parallel side faces of sliding block 19, which cooperate with the parallel wall faces of slit 18 of sliding shaft 17, and the barycenters of the hollow shaft cutout faces 15, 16 cooperating with the leg faces 13, 14 of eccentric disk 5 lie in a common plane, namely in the longitudinal median plane of eccentric disk 5.

As can be seen especially clearly in FIG. 1, the hollow shaft 4 is designed as a hydraulic cylinder, while the sliding shaft 17 is formed as a double-action hydraulic piston which is movable in both directions axially inside the hollow shaft 4 by means of a hydraulic fluid 23.

At its two open ends the hollow shaft 4 is closed with a cylinder cover 24, 25 in such a way that a tight hydraulic cylinder is formed. The cylinder has near its two ends radial bores 26, 27 distributed over the circumference, which serve as inlet and outlet openings for the hydraulic fluid 23 and, as the hollow shaft 4 rotates, continuously pass over corresponding annular grooves 28 or respectively cooperate with them. These annular grooves 28 are provided in slide rings 29 of the engine housing 1 and are connected through channels 30 with the hydraulic admission and discharge line 31.

This hydraulic line 31 is connected via a control valve 32 to a pump 33 which in the embodiment shown serves not only for stroke adjustment but at the same time for pressure lubrication of the actual pump engine. This means that the hydraulic fluid 23 for the actuation of the sliding shaft 17 designed as hydraulic piston is a lubricating oil suitable for pressure lubrication of the pump engine.

At its right end according to FIG. 1, the sliding shaft 17 is provided with a position signaler 34, which records the respective position of the sliding shaft 17 as actual value. For this purpose, a rod 35 connected with sliding shaft 17 at the end face protrudes axially into the hollow shaft 4 away from shaft 17. At its free end, rod 35 is connected with a cross-rod 37 which at its two ends, rotating together with rod 35 and sliding shaft 17, protrudes from corresponding radial openings 38 of hollow shaft 4 to the outside and there engages in a non-rotational but axially displaceable sliding ring 39. The transmission of the axial motion from the rotating cross-rod 37 to the non-rotational sliding ring 39 occurs by means of sliding shoes 44 which are firmly connected with the cross-rod 37 and engage in an annular groove of the sliding ring 39. The particular position of sliding ring 39, for example in relation to a resistance winding 40, gives in simple manner a corresponding indication for the actual value of the position of sliding shaft 17 and hence of the stroke length, this indication being then signaled as an electrical signal to a control unit 41, in which the desired value of the sliding shaft position or of the stroke length is settable.

In this control unit 41 the actual value is compared with the desired value of the sliding shaft position and the deviation is sent as correcting value to the control valve 32. Then, an appropriate manner, the latter divides the hydraulic fluid 23 pumped by pump 33 in such a way that the sliding shaft 17 moves accordingly, and this until the actual value of the position of sliding shaft 17 indicated by the position signaler 34 coincides with the desired value entered in the control unit 41. This desired value, by the way, can be set manually in a simple manner without any special force being required.

As the axial adjusting movement of the sliding shaft is not brought out of the hollow shaft 4 axially to the outside, the two ends of hollow shaft 4 can be used for coupling any number of additional engines or pumps. This can be seen e.g. from FIGS. 4 and 5.

In the modified form according to FIG. 3, the position signaler, which signals the actual value of the stroke length to the control unit 41, is designed as a stroke length sensor 43, which measures the stroke length or respectively the actual value thereof directly at the piston rod 9 and which in the illustrated embodiment may be provided e.g. as an inductive displacement transducer. As can be seen from FIG. 3, the stroke length sensor 43 can have a lower extreme position, shown in solid lines, and an upper extreme position shown in dash-dot lines, as well as any desired position therebetween. For the indication of the actual value of the respective stroke length one uses the difference of the two extreme positions of the stroke length sensor 43.

Since, in contrast to FIG. 1, no position signaler is provided at the right end of hollow shaft 4, an additional engine or additional pump can be coupled at a still smaller distance than in the embodiment of FIG. 1.

Besides, it is clear from FIG. 3—as also from FIG. 1—that also the respective bearing distance A between the shaft bearings 2 and 3 is definitely reduced due to the described design.

In the additionally modified embodiment of FIG. 4, the coupling of two engines I and II or respectively of two pumps side by side is illustrated, the adjustment of the respective stroke length being controlled centrally from a single control unit 41. This control unit 41, however, influence two control valves 32, **32*a*, which are assigned to the respective stroke adjusting device, so as to be able to set different stroke lengths for each engine. The different desired values of the stroke lengths of engine I and engine II are entered in the control unit 41 and are compared therein with the stroke length value delivered as actual value, whereupon the respective deviation is given out to the control valve 32, 32*a*, so that the respective adjustment of the sliding shaft 17, 17*a* occurs accordingly via the oil pump 33**.

In this form of realization, each engine I, II has a separate position signaler, which is a stroke length sensor 43 measuring the actual value of the stroke length directly at the piston rod 9. Its design is clearly evident from the drawing in all necessary details.

In the form of realization of FIG. 5, again two pumps or engines I, II are coupled side by side on the drive shaft 4, **4*a*. Since in this form a synchronous stroke setting occurs, i.e. the respective stroke lengths are to be adjusted synchronously, only the first hollow shaft 4 is designed as hydraulic cylinder and accordingly the associated sliding shaft 17 as double-action hydraulic piston. As distinguished therefrom, for the right engine II according to FIG. 5 the hollow shaft 4*a* is indeed provided with the sliding shaft 17*a* slidable therein, but the hollow shaft 4*a*** is not formed as a closed cylinder with cylinder covers.

To achieve the synchronous stroke setting or stroke adjustment, however, the first sliding shaft 17 is firmly connected with the second sliding shaft **17*a* by a thrust rod 42, with the possibility, of course, as indicated at right in FIG. 5**, that a connection also with the sliding shafts of additional coupled engines or pumps can be carried out.

Naturally, in the embodiment according to FIG. 5 it suffices to provide a single position signaler 43 for the indication of the stroke length. This is realized by the stroke length sensor 43 at the first engine, which measures the stroke length actual value directly at the piston rod 9 and then supplies it to the control unit 41.

I claim:

1. A stroke adjusting device for a oscillating displacement pump, said device comprising an eccentric disk for converting rotary motion of a drive wheel into an oscillating motion of a connecting rod arranged at right angles to said drive wheel; a hollow shaft mounted rotatably but fixed axially in a propulsion mechanism housing, said hollow shaft attached to said drive wheel for rotary motion therewith and attached to said eccentric disk for rotating said eccentric disk said hollow shaft containing a sliding shaft coupled with said eccentric disk via a positioning element slot obliquely inclined to the axis of said sliding shaft, characterized in that an inner portion of said hollow shaft has a portion closed by cylinder covers to define a hydraulic cylinder therien in which the sliding shaft operates as a double action hydraulic piston for displacement of said positioning element along the axis of said hollow shaft, in both directions, by a hydraulic fluid, said displacement adjusting the stroke of one of said oscillating displacement pumps connected to said eccentric disk, the stroke adjusted by shifting said positioning element.

2. Device according to claim 1, characterized in that, with multicylinder pumps, the respective sliding shafts (17, **17*a*) are firmly connected together by thrust rods (42), and the first hollow shaft (4) is designed as a hydraulic cylinder, while the associated sliding shaft (17**) is designed as a hydraulic piston.

3. Device according to claim 1 or 2, characterized in that the sliding shaft (17) is in operative connection with a position signaler (34,43) which records the particular position of the sliding shaft (17) or respectively length of the stroke of the sliding shaft as actual value and signals a control unit (41) in which the actual value of the sliding shaft position or stroke length can be set.

4. Device according to claim 3, characterized in that the position signaler which signals the actual value of the stroke length to the control unit (41) is a stroke length sensor (43) which measures the stroke length directly at the piston rod (9).

5. Device according to claim 4, characterized in that the stroke length sensor (43) is an inductive displacement transducer.

6. Device according to claim 3, characterized in that the position signaler (34) of the sliding shaft (17) has a linkage (35, 37) connected with the latter for position indication of the sliding shaft (17).

7. Device according to claim 8, characterized in that the linkage is a rod (35) extending axially away from the sliding shaft (17) and having a transverse rod (37) connected with it which engages in a non-rotational, axially displaceable sliding ring (39).

8. Device according to one of claim 3 characterized in that the position signaler (34) of the sliding shaft (17) is designed to operate electronically.

9. Device according to one of claims 1, characterized in that the control unit (41) divides the fluid stream of a pressure medium pump (33) via at least one control valve (32) in such a way that the stroke length actual value coincides with a set desired value.

10. Device according to one of claims 1, characterized in that the hydraulic fluid (23) for actuation of the hydraulic piston (17) is a lubricating oil which serves at the same time for pressure lubrication of the pump engine.

11. The oscillating displacement pump according to claim 11 wherein additional eccentric propulsion mechanisms are coupled to at least one of the ends of said hollow shaft and/or said sliding shaft.

* * * * *